US009165528B2

(12) United States Patent
Kim et al.

(10) Patent No.: US 9,165,528 B2
(45) Date of Patent: Oct. 20, 2015

(54) DISPLAY SYSTEMS FOR REDUCING POWER CONSUMPTION AND METHODS FOR DRIVING THE SAME

(71) Applicant: Samsung Electronics Co., Ltd., Suwon-Si, Gyeonggi-Do (KR)

(72) Inventors: Sungchul Kim, Hwaseong-si (KR); Young Min Kim, Yongin-si (KR); Sangjoon Hyung, Seoul (KR); Seokhee Hwang, Seoul (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 64 days.

(21) Appl. No.: 14/047,160

(22) Filed: Oct. 7, 2013

(65) Prior Publication Data

US 2014/0104327 A1 Apr. 17, 2014

(30) Foreign Application Priority Data

Oct. 11, 2012 (KR) ..... 10-2012-0113017

(51) Int. Cl.
*G09G 5/02* (2006.01)
*G09G 3/20* (2006.01)

(52) U.S. Cl.
CPC .. *G09G 5/02* (2013.01); *G09G 3/20* (2013.01); *G09G 2310/0275* (2013.01); *G09G 2310/0281* (2013.01); *G09G 2310/04* (2013.01); *G09G 2330/021* (2013.01); *G09G 2330/022* (2013.01); *G09G 2340/16* (2013.01); *G09G 2360/12* (2013.01); *G09G 2360/127* (2013.01)

(58) Field of Classification Search
CPC ..... G09G 5/02; G09G 3/20
USPC ..... 345/690–691, 212, 213, 204, 211, 589
See application file for complete search history.

(56) References Cited

U.S. PATENT DOCUMENTS

| | | | | |
|---|---|---|---|---|
| 8,344,996 | B2 | 1/2013 | Lai et al. | |
| 2002/0140685 | A1 | 10/2002 | Yamamoto et al. | |
| 2004/0233152 | A1 | 11/2004 | Wang et al. | |
| 2008/0211794 | A1 | 9/2008 | Yi et al. | |
| 2010/0039362 | A1 | 2/2010 | Chien et al. | |
| 2010/0156928 | A1* | 6/2010 | Lee et al. | 345/589 |
| 2010/0321402 | A1 | 12/2010 | Han et al. | |

(Continued)

FOREIGN PATENT DOCUMENTS

| | | | |
|---|---|---|---|
| JP | H08-278486 | A | 10/1996 |
| JP | 2002-287681 | A | 10/2002 |
| JP | 2004-302355 | A | 10/2004 |
| JP | 2011-028269 | A | 2/2011 |

(Continued)

*Primary Examiner* — Shaheda Abdin
(74) *Attorney, Agent, or Firm* — Harness, Dickey & Pierce, PLC

(57) ABSTRACT

A display system may include a system board configured to compare image signals of a current and previous frame and configured to output the image signals of the current frame and a comparison result; a display panel configured to receive data signals in response to gate signals and configured to include pixels for displaying images corresponding to the data signals; a timing controller configured to output image signals and control signals; a gate driving unit configured to provide the gate signals to the pixels in response to the control signals; and/or a data driving unit configured to store the image signals provided from the timing controller and configured to convert the image signals into the data signals in response to the control signals, the data signals being provided to the pixels.

19 Claims, 8 Drawing Sheets

(56) References Cited

U.S. PATENT DOCUMENTS

| | | | | |
|---|---|---|---|---|
| 2011/0018857 | A1 | 1/2011 | Lai et al. | |
| 2011/0273424 | A1* | 11/2011 | Hwang et al. | 345/211 |
| 2011/0292016 | A1 | 12/2011 | Aoki et al. | |
| 2012/0019508 | A1 | 1/2012 | Wei et al. | |
| 2012/0320108 | A1 | 12/2012 | Sampsell | |

FOREIGN PATENT DOCUMENTS

| | | | |
|---|---|---|---|
| KR | 2002-0062430 | A | 7/2002 |
| KR | 10-0631398 | B1 | 6/2004 |
| KR | 2005-0062116 | A | 6/2005 |
| KR | 2006-0092930 | A | 8/2006 |
| KR | 2008-0044015 | A | 5/2008 |

* cited by examiner

DISPLAY SYSTEMS FOR REDUCING POWER CONSUMPTION AND METHODS FOR DRIVING THE SAME

CROSS-REFERENCE TO RELATED APPLICATION(S)

This application claims priority from Korean Patent Application No. 10-2012-0113017, filed on Oct. 11, 2012, in the Korean Intellectual Property Office (KIPO), the entire contents of which are incorporated herein by reference.

BACKGROUND

1. Field

Some example embodiments may relate to display systems capable of display image signals and/or methods for driving the same.

2. Description of Related Art

A typical display system may include a system board and a display device to display an image signal provided from the system board. The system board may provide the display device with image signals and control signals for controlling the display device. The display device may display the image signals in response to the control signals provided from the system board.

The display device may include a plurality of pixels for displaying the image signals, and data and gate driving units for driving the pixels. Each of the pixels may receive data signals provided from the data driving unit in response to gate signals provided from the gate driving unit. The data signals may be analog data voltages corresponding to the image signal. The pixels may display gray scale corresponding to the data signals.

As the display device, there may be developed various display devices such as an Liquid Crystal Display (LCD) device, an Organic Light Emitting Diode (OLED) device, an electro-wetting display device, an electrophoretic display device, and so on. In recent years, there may have been required a technique for reducing power consumption of a display system using such display devices.

SUMMARY

Some example embodiments may provide display systems capable of display image signals and/or methods for driving the same.

In some example embodiments, a display system may comprise a system board configured to compare image signals of a current frame and image signals of a previous frame and configured to output the image signals of the current frame and a comparison result according to the comparison result; a display panel configured to receive data signals in response to gate signals and configured to include a plurality of pixels for displaying images corresponding to the data signals; a timing controller configured to output image signals and control signals; a gate driving unit configured to provide the gate signals to the plurality of pixels in response to the control signals; and/or a data driving unit configured to store the image signals provided from the timing controller and configured to convert the image signals into the data signals in response to the control signals, the data signals being provided to the plurality of pixels. The timing controller may provide the data driving unit with updated image signals of the image signals of the current frame provided from the system board based on the comparison result.

In some example embodiments, the data driving unit may be configured to convert, into the data signals, the updated image signals of the image signals of the current frame and stored image signals of the previous frame equal to image signals of the current frame not updated.

In some example embodiments, the display panel may further comprise a plurality of display areas configured to include corresponding pixels of the plurality of pixels, and/or the data driving unit may be configured to include a plurality of source integrated circuits (ICs) corresponding to the plurality of display areas and providing the data signals to pixels of the corresponding display areas.

In some example embodiments, if the image signals of the current frame include the updated image signals, the system board may be configured to provide the timing controller with location information of the updated image signals and the image signals of the current frame as the comparison result.

In some example embodiments, the timing controller may be configured to extract a coordinate value of the updated image signals using the location information of the updated image signals.

In some example embodiments, the timing controller may be configured to provide the updated image signals to the source ICs corresponding to the plurality of display areas at which the updated image signals are to be displayed, based on the coordinate value, and is configured to not to provide the source ICs with the image signals not updated.

In some example embodiments, each of the source ICs may include a frame memory configured to store image signals provided from the timing controller.

In some example embodiments, the frame memories of the source ICs provided with the updated image signals may be configured to store the updated image signals provided from the timing controller and configured to convert the updated image signals into the data signals.

In some example embodiments, the image signals stored at the frame memories of the source ICs not provided with the image signals not updated from the timing controller may be converted into the data signals.

In some example embodiments, if the image signals of the previous frame are equal to the image signals of the current frame, the system board may not provide the image signals of the current frame to the timing controller, and/or the data driving unit may convert the image signals of the previous frame stored into the data signals to be provided to the pixels of the display panel.

In some example embodiments, a method for driving a display system that comprises a plurality of pixels for displaying an image corresponding to data signals may comprise comparing image signals of a current frame with image signals of a previous frame; determining whether the image signals of the current frame include updated image signals based on the comparison result; extracting a coordinate value of the updated image signals if the image signals of the current frame include the updated image signals; determining whether all image signals of the current frame are updated based on the coordinate value of the updated image signals; storing partially updated image signals of the image signals of the current frame if the image signals of the current frame are partially updated; converting into data signals the partially updated image signals of the image signals of the current frame and the image signals of a previous frame stored equal to image signals not updated; and/or providing the data signals to the plurality of pixels.

In some example embodiments, the method may further comprise storing all image signals of the current frame if all image signals of the current frame are updated; and/or converting all image signals of the current frame into the data signals.

In some example embodiments, the method may further comprise converting the image signals of the previous frame stored into the data signals if the image signals of the current frame don't include the updated image signals.

In some example embodiments, a display system may comprise a display panel configured to include a plurality of pixels for displaying images corresponding to data signals; a system board configured to output first image signals and first control signals; a timing controller configured to output second image signals, second control signals, and third control signals based on the first image signals and the first control signals; a data driving unit configured to store the second image signals and configured to convert the second image signals into data signals in response to the second control signals; and/or a gate driving unit configured to provide gate signals to the plurality of pixels in response to the third control signals. The system board may be further configured to compare image signals of a current frame and image signals of a previous frame and further configured to output the image signals of the current frame according to the comparison result. The timing controller may be configured to provide the data driving unit with updated image signals of the image signals of the current frame provided from the system board based on the comparison result. The plurality of pixels of the display panel may be configured to receive the data signals.

In some example embodiments, the first image signals may include first red, green, and blue image signals.

In some example embodiments, the second image signals may include second red, green, and blue image signals.

In some example embodiments, the first image signals may include first red, green, and blue image signals, and/or the second image signals may include second red, green, and blue image signals converted from the first red, green, and blue image signals.

In some example embodiments, the second control signals may include data control signals.

In some example embodiments, the third control signals may include gate control signals.

In some example embodiments, the data driving unit may comprise a plurality of frame memories configured to store the second image signals.

In some example embodiments, the display panel may comprise a plurality of rows and columns of the plurality of pixels.

In some example embodiments, the display panel may further comprise a plurality of display areas, and/or each of the plurality of display areas may correspond to two or more columns of the plurality of pixels.

In some example embodiments, the display panel may further comprise a plurality of image change areas, and/or each of the plurality of image change areas may correspond to two or more rows and two or more columns of the plurality of pixels.

BRIEF DESCRIPTION OF THE DRAWINGS

The above and/or other aspects and advantages will become more apparent and more readily appreciated from the following detailed description of example embodiments, taken in conjunction with the accompanying drawings, in which.

DETAILED DESCRIPTION OF THE EMBODIMENTS

Figure 1:
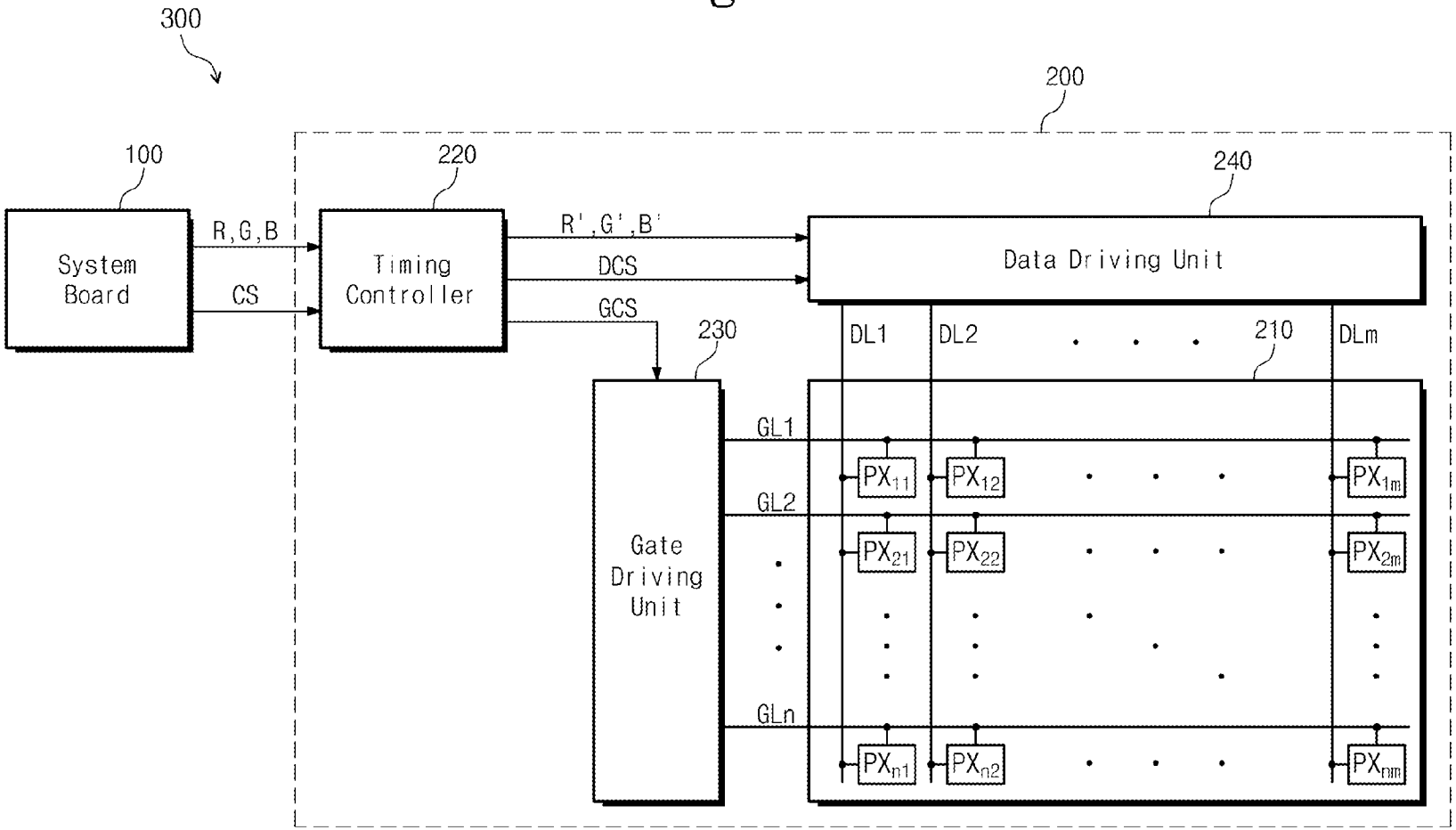
FIG. 1 is a block diagram schematically illustrating a display system according to some example embodiments of the inventive concept.

Example embodiments will now be described more fully with reference to the accompanying drawings. Embodiments, however, may be embodied in many different forms and should not be construed as being limited to the embodiments set forth herein. Rather, these example embodiments are provided so that this disclosure will be thorough and complete, and will fully convey the scope to those skilled in the art. In the drawings, the thicknesses of layers and regions may be exaggerated for clarity.

It will be understood that when an element is referred to as being "on," "connected to," "electrically connected to," or "coupled to" to another component, it may be directly on, connected to, electrically connected to, or coupled to the other component or intervening components may be present. In contrast, when a component is referred to as being "directly on," "directly connected to," "directly electrically connected to," or "directly coupled to" another component, there are no intervening components present. As used herein, the term "and/or" includes any and all combinations of one or more of the associated listed items.

It will be understood that although the terms first, second, third, etc., may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. For example, a first element, component, region, layer, and/or section could be termed a second element, component, region, layer, and/or section without departing from the teachings of example embodiments.

Spatially relative terms, such as "beneath," "below," "lower," "above," "upper," and the like may be used herein for ease of description to describe the relationship of one component and/or feature to another component and/or feature, or other component(s) and/or feature(s), as illustrated in the drawings. It will be understood that the spatially relative terms are intended to encompass different orientations of the device in use or operation in addition to the orientation depicted in the figures.

The terminology used herein is for the purpose of describing particular example embodiments only and is not intended to be limiting of example embodiments. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

Example embodiments may be described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will typically have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature, their shapes are not intended to illustrate the actual shape of a region of a device, and their shapes are not intended to limit the scope of the example embodiments.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

Reference will now be made to example embodiments, which are illustrated in the accompanying drawings, wherein like reference numerals may refer to like components throughout.

FIG. 1 is a block diagram schematically illustrating a display system according to some example embodiments of the inventive concept.

Referring to FIG. 1, a display system 300 of the inventive concept may include a system board 100 and a display device 200.

The system board 100 may provide the display device 200 with image signals R, G, and B and a control signal CS. The system board 100 may provide the image signals R, G, and B to the display device 200 by the frame. The image signals in each frame may include pixel location information and pixel data. The pixel location information may be information indicating a location where an image signal is to be displayed. The pixel data may have color information such as red, green, and blue. Although not shown in FIG. 1, the control signal CS may include a horizontal synchronization signal H_SYNC, a vertical synchronization signal V_SYNC, a main clock signal MCLK, a data enable signal DE, and so on.

The display device 200 may include a display panel 210, a timing controller 220, a gate driving unit 230, and a data driving unit 240.

The display panel 210 may include a plurality of pixels PX11 to PXnm arranged in a matrix form, a plurality of gate lines GL1 to GLn connected with the pixels PX11 to PXnm by the row, and a plurality of data lines DL1 to DLm intersected with the gate lines GL1 to GLn and connected with the pixels PX11 to PXnm by the column. The pixels PX11 to PXnm may be connected with corresponding gate lines GL1 to GLn and corresponding data lines DL1 to DLm, respectively. Herein, 'n' and 'm' may be integers greater than 0.

The gate lines GL1 to GLn may be connected with the gate driving unit 230 to receive gate signals. The data lines DL1 to DLm may be connected with the data driving unit 240 to receive data signals.

The timing controller 220 may receive the image signals and the control signal CS from the system board 100. The timing controller 220 may convert a data format of the image signals R, G, and B into a data format appropriate to an interface between the data driving unit 240 and the timing controller 220. The timing controller 220 may provide the data driving unit 240 with image signals R', G', and B' having the converted data format.

The timing controller 220 may generate a gate control signal GCS and a data control signal DCS in response to the control signal CS provided from the system board 100. The gate control signal GCS may be a control signal for controlling operating timing of the gate driving unit 230. The data control signal DCS may be a control signal for controlling operating timing of the data driving unit 240.

Although not shown in FIG. 1, the data control signal DCS may include a latch signal TP, a horizontal start signal STH, a polarity control signal POL, a clock signal HCLK, and so on. The gate control signal GCS may include a vertical start signal STV, a gate clock signal CPV, an output enable signal OE, and so on.

The timing controller 220 may provide the gate control signal GCS to the gate driving unit 230 and the data control signal DCS to the data driving unit 240.

The gate driving unit 230 may sequentially output gate signals in response to the gate control signal GCS provided from the timing controller 220. The gate signals may be applied to the pixels PX11 to PXnm through the gate lines GL1 to GLn sequentially and by the row. Thus, the pixels PX11 to PXnm may be driven by the row.

The data driving unit 240 may convert the image signals R', G', and B' into data signals in response to the data control signal DCS provided from the timing controller 220. Also, the data driving unit 240 may store the image signals R', G', and B' provided from the timing controller 220. The data signals may be analog data voltages corresponding to the image signals R', G', and B'. The data signals may be applied to the pixels PX11 to PXnm through the data lines DL1 to DLm.

Although not shown in FIG. 1, the gate driving unit 230 may be mounted at a left or right side of the display panel 210 in an Amorphous Silicon thin-film transistor (TFT) Gate driver circuit (ASG) form. The data driving unit 240 may include a plurality of source driver chips. The source driver chips may be connected with the display panel 210 in a Tape Carrier Package (TCP) manner or a Chip on Glass (COG) manner.

Each of the pixels PX11 to PXnm may receive a data voltage via a corresponding data line in response to a gate signal provided via a corresponding gate line. Thus, the pixels PX11 to PXnm may display gray scale corresponding to the data signals.

The system board 100 may compare image signals R, G, and B of a previous frame and image signals R, G, and B of a current frame. If the image signals R, G, and B of the previous frame are equal to the image signals R, G, and B of the current frame, the system board 100 may not provide the image signals R, G, and B of the current frame to the timing controller 220 of the display device 200. That is, in the event that the image signals R, G, and B of the current frame are not updated in comparison with the image signals R, G, and B of the previous frame, the system board 100 may not provide image signals R, G, and B to the timing controller 220. Thus, there is not consumed a power necessary to transfer image signals R, G, and B from the system board 100 to the timing controller 220.

Since image signals R, G, and B are not provided from the system board 100, the timing controller 220 may not provide image signals R', G', and B' to the data driving unit 240. Thus, there is not consumed a power necessary to transfer image signals R', G', and B' from the timing controller 220 to the data driving unit 240.

Image signals R', G', and B' of a previous frame may be stored at the data driving unit 240. The data driving unit 240 may convert and output the image signals R', G', and B' of the previous frame into data signals in response to the data control signal DCS. Thus, pixels of the display panel 210 may display the image signals R', G', and B' of the previous frame again.

In the case that a different area exists between the image signals R, G, and B of a previous frame and the image signals R, G, and B of a current frame, the system board 100 may search an area of image signals, different from the image signals R, G, and B of the previous frame, from among the image signals R, G, and B of the current frame. Image signals, different from the image signals R, G, and B of the previous frame, from among the image signals R, G, and B of the current frame may be image signals which are updated at the current frame. That is, in the event that an image signal area updated at the current frame exists, the system board 100 may search an area of updated image signals of the image signals of the current frame. The updated image signals may be the whole image or a part of the whole image. The area of the updated image signals may include information on a location where the updated image signals are displayed.

The system board 100 may provide the timing controller 220 of the display device 200 with location information of the updated image signal area as a comparison result. Also, the system board 100 may provide the timing controller 220 with image signals R, G, and B of a current frame together with the location information of the updated image signal area.

If the whole image is updated, location information of the updated image signal area may correspond to all pixels of the display panel 210. The timing controller 220 may convert a data format of image signals R, G, and B of a current frame based on the location information of the updated image signal area, and may provide the converted image signals to the data driving unit 240. The data driving unit 240 may store the image signals R', G', and B' of the current frame provided from the timing controller 220. Also, the data driving unit 240 may convert the image signals R', G', and B' of the current frame having the converted data format into data signals. The data signals may be applied to the pixels PX11 to PXnm via the data lines DL1 to DLm. Thus, the whole image changed at the current frame may be displayed by the display panel 210.

If an image is partially updated, the timing controller 220 may provide the data driving unit 240 with partially updated image signals of the image signals of the current frame using the location information of the updated image signal area. Image signals not updated may not be provided to the data driving unit 240. Thus, there is not consumed a power necessary to transfer the image signals not updated from the timing controller 220 to the data driving unit 240.

The data driving unit 240 may store the partially updated image signals of the image signals of the current frame. Also, the data driving unit 240 may convert the partially updated image signals of the image signals of the current frame into data signals. The data signals may be applied to pixels at an area of the display panel 210 where the partially updated image signals are displayed. The image signals of an area which is updated at the current frame may be displayed by the display panel 210.

Image signals not updated at the current frame may be image signals equal to image signals of a previous frame. The image signals not updated at the current frame were stored at the data driving unit 240. Thus, the data driving unit 240 may output data signals using image signals of the previous frame stored equal to image signals not updated. The image signals not updated at the current frame may be displayed by the display panel 210.

The image signals not updated may be displayed by the display panel 210 using image signals previously stored at the data driving unit 240. This may mean that a power necessary to transfer the image signals not updated is not consumed. Thus, power consumption of the display system 300 of the inventive concept may be reduced.

Figure 2A:
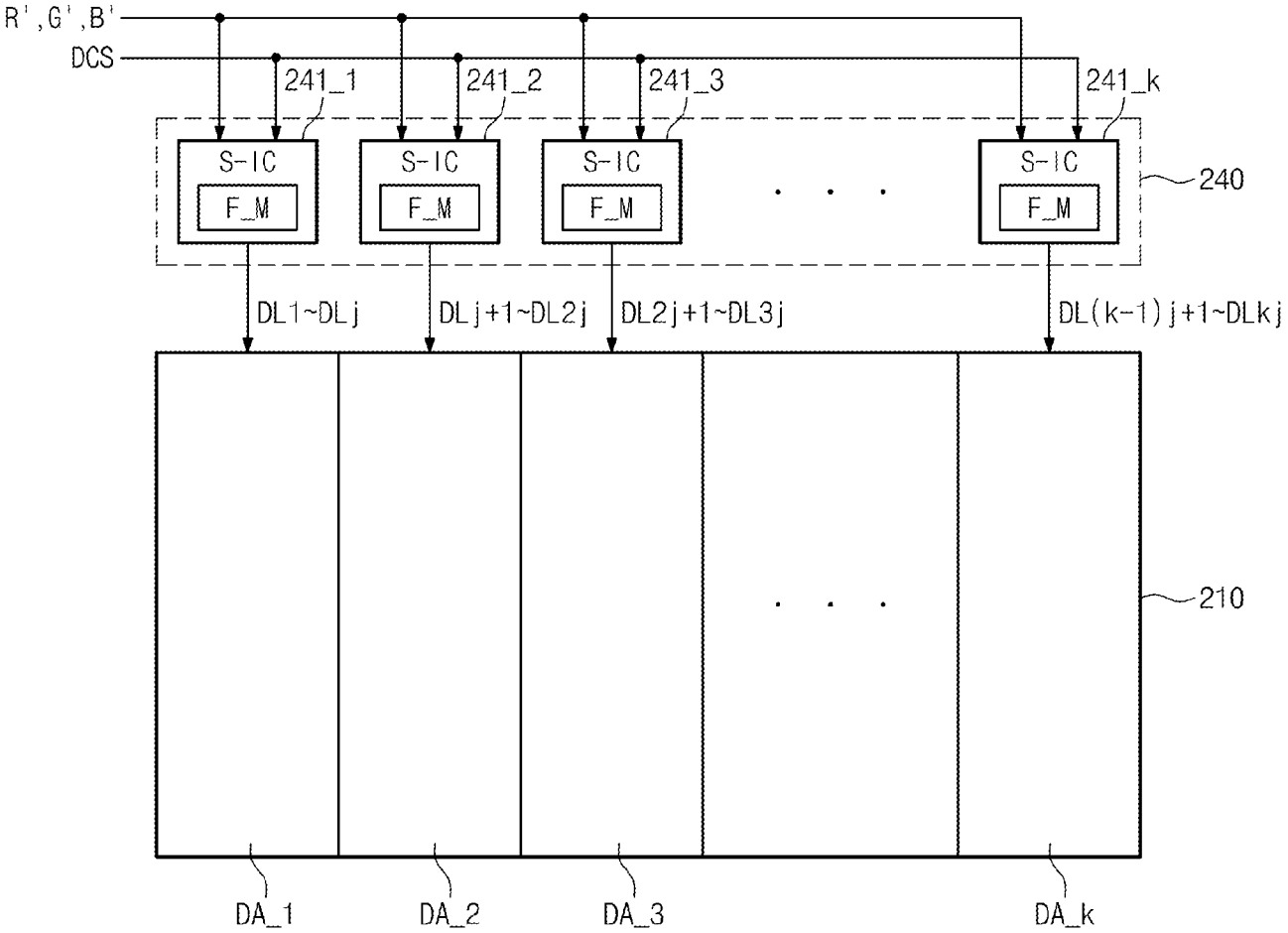
FIGS. 2A and 2B are block diagrams illustrating a data driving unit of FIG. 1.
Figure 2B:
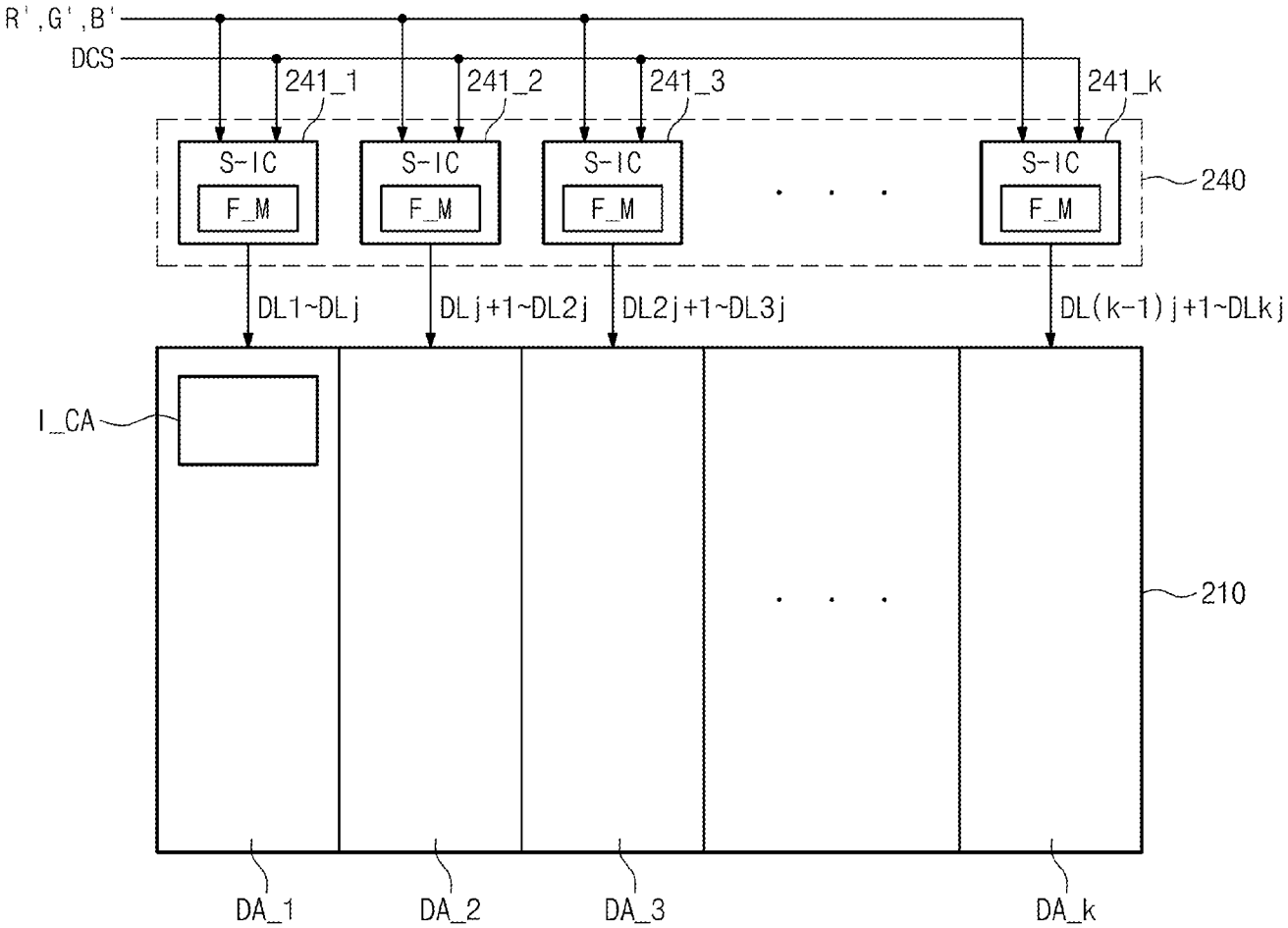

FIGS. 2A and 2B are block diagrams illustrating a data driving unit 240 of FIG. 1.

Referring to FIGS. 2A and 2B, a data driving unit 240 may include a plurality of source integrated circuits (ICs) (S-IC) 241_1 to 241_*k*. A display panel 210 may include a plurality of display areas DA_1 to DA_k respectively corresponding to the source ICs 241_1 to 241_*k*. The display areas DA_1 to DA_k may include corresponding pixels of a plurality of pixels PX11 to PXnm. For example, the display areas DA_1 to DA_k may include the same number of pixels.

As described above, the image signals R, G, and B may include pixel location information. A timing controller 220 may divide the image signals to be displayed at the display areas DA_1 to DA_k by the display area based on the pixel location information. The timing controller 220 may provide the image signals divided by the display area with corresponding source ICs 241_1 to 241_*k*.

For example, the source ICs 241_1 to 241_*k* may include first to kth source ICs 241_1 to 241_*k*, and the display areas DA_1 to DA_k may include first to kth display areas DA_1 to DA_k. In this case, image signals to be displayed at the first display area DA_1 may be provide to the first source IC 241_1, and image signals to be displayed at the second display area DA_2 may be provide to the second source IC 241_2. Likewise, image signals to be displayed at the third to kth display areas DA_3 to DA_k may be provide to the third to kth source ICs 241_3 to 241_*k*, respectively.

The image signals R', G', and B' may be uniformly divided to be provided to the source ICs 241_1 to 241_*k*. For example, if a capacity of the image signals R', G', and B' is 3 MB and the number of the source ICs 241_1 to 241_*k* is 6, image signals of 500 KB may be provided to each of the source ICs 241_1 to 241_*k*.

Each of the source ICs 241_1 to 241_*k* may include a frame memory F_M. The frame memories F_M of the source ICs 241_1 to 241_*k* may have the same capacity. Image signals R', G', and B' which are uniformly divided and provided to the source ICs 241_1 to 241_*k* may be stored at the frame memories F_M of the source ICs 241_1 to 241_*k*. Also, each of the source ICs 241_1 to 241_*k* may convert the image signals R', G', and B' into data signals in response to the data control signal DCS.

The source ICs 241_1 to 241_*k* may be connected with pixels of corresponding display areas DA_1 to DA_k via the same number of data lines. For example, the data lines DL1 to DLm may be divided into data line groups each including the same number of data lines. The number of the data line groups may correspond to the number of the source ICs 241_1 to 241_*k*. Thus, since the source ICs 241_1 to 241_*k* include the first to kth source ICs 241_1 to 241_*k*, the data line groups may include first to kth groups (DL1 to DLj), (DLj+1 to DL2*j*), (DL2*j*+1 to DL3*j*), . . . , (DL(k−1)j+1 to DLkj). Herein, a product of 'k' and 'j' may be equal to 'm'.

The source ICs 241_1 to 241_*k* may provide the data signals to the corresponding display areas DA_1 to DA_k via the corresponding data line groups (DL1 to DLj), (DLj+1 to DL2*j*), (DL2*j*+1 to DL3*j*), . . . , (DL(k−1)j+1 to DLkj). Thus, pixels PX11 to PXnm of the first to kth display areas DA_1 to DA_k may display an image corresponding to the data signals.

If the image signals R, G, and B of the previous frame are equal to the image signals R, G, and B of the current frame, a system board 100 may not provide the image signals R, G, and B of the current frame to the timing controller 220 of a display device 200. Since image signals are not provided from the system board 100, the timing controller 220 may not provide the image signals R', G', and B' having a converted data format to a data driving unit 240.

The image signals R', G', and B' of a previous frame may be stored at the frame memories F_M of the source ICs 241_1 to 241_*k* in the data driving unit 240. The source ICs 241_1 to 241_*k* may convert and output the image signals R', G', and B' of the previous frame stored at the frame memories F_M into the data signals in response to the data control signal DCS, respectively. Thus, the pixels of the display panel 210 may display the image signals R', G', and B' of the previous frame again.

In the case that a different area exists between the image signals R, G, and B of the previous frame and the image signals R, G, and B of the current frame, the system board 100 may provide the timing controller 220 with image signals R, G, and B of the current frame together with location information of an updated image signal area.

If the whole image is updated, the timing controller 220 may convert a data format of the image signals R, G, and B of the current frame. Also, the timing controller 220 may extract a coordinate value using the location information of the updated image signal area. If the whole image is updated, the location information of the updated image signal area may correspond to all pixels PX11 to PXnm of the display panel 210, respectively. Thus, the timing controller 220 may divide image signals R', G', and B' to be displayed at the display areas DA_1 to DA_k by the display area based on the coordinate value of the location information of the image signal area. The timing controller 220 may provide the image signals R', G', and B' divided by the display area to corresponding source ICs 241_1 to 241_*k*, respectively.

Although not shown, interface units for transferring image signals R', G', and B' may be disposed between the timing controller 220 and the source ICs 241_1 to 241_*k*. If the whole image is updated, the timing controller 220 may activate interface units for transferring the image signals to the source ICs 241_1 to 241_*k*. That is, the timing controller 220 may select the source ICs 241_1 to 241_*k*. The timing controller 220 may provide image signals R', G', and B' divided by the display area to corresponding source ICs 241_1 to 241_*k* via interface units.

The image signals R', G', and B' of the current frame provided from the timing controller 220 may be stored at the frame memories F_M of the source ICs 241_1 to 241_*k*. Also, the source ICs 241_1 to 241_*k* may convert the image signals R', G', and B' of the current frame into the data signals. The data signals may be applied to the pixels PX11 to PXnm through data lines DL1 to DLm. Thus, the whole image changed at the current frame may be displayed by the display panel 210.

If an image is partially updated, the timing controller 220 may provide the data driving unit 240 with partially updated image signals of the image signal the current frame using the location information of the updated image signal area. Image signals not updated may not be provided to the data driving unit 240. Thus, image signals partially updated at the current frame was stored at the data driving unit 240 as the same image signals of the image signals of a previous frame.

As illustrated in FIG. 2B, for example, in a current frame, an image of an image change area I_CA of a first display area DA_1 may be updated. The system board 100 may compare the image signals of a previous frame and the image signals of a current frame to search image signals to be displayed at the image change area I_CA of the first display area DA_1 as an updated image signal area. The system board 100 may provide the timing controller 220 with image signals R', G', and B' of the current frame together with the location information of the image signals to be displayed at the image change area I_CA.

The timing controller 220 may extract a coordinate value of the image signals to be displayed at the image change area I_CA using the location information of the image signals to be displayed at the image change area I_CA. The timing controller 220 may provide the first source IC 241_1 with the image signals to be displayed at the image change area I_CA based on the coordinate value of the image signals to be displayed at the image change area I_CA.

For example, in the event that an image of the image change area I_CA of the first display area DA_1 is updated, the timing controller 220 may activate an interface unit for transferring image signals to the first source IC 241_1. The timing controller 220 may inactivate interface units for transferring image signals to the second to kth source ICs 241_2 to 241_*k*. That is, the timing controller 220 may select the first source IC 241_1, while it does not select the second to kth source ICs 241_2 to 241_*k*.

The timing controller 220 may provide the first source IC 241_1 with the image signals to be displayed at the image change area I_CA, while it does not provide the image signals to the second to kth source ICs 241_2 to 241_*k*. In this case, since interface units for transferring the image signals to the second to kth source ICs 241_2 to 241_*k* are not used, power consumption may be reduced. That is, since the image signals not updated are not transferred from the timing controller 220 to the second to kth source ICs 241_2 to 241_*k*, power consumption may be reduced.

The image signals to be displayed at the image change area I_CA may be stored at the frame memory F_M of the first source IC 241_1. Also, the first source IC 241_1 may convert the image signals to be displayed at the image change area I_CA into data signals in response to a data control signal DCS. The data signals may be applied to pixels of the image change area I_CA of the first display area DA_1. Thus, the image signals updated at the current frame may be displayed at the image change area I_CA of the first display area DA_1 in the display panel 210.

The image signals of a previous frame were stored at the frame memories F_M of the second to kth source ICs 241_2 to 241_*k*. The second to kth source ICs 241_2 to 241_*k* may convert the image signals of the previous frame into data signals in response to the data control signal DCS. The second to kth source ICs 241_2 to 241_*k* may provide the data signals to pixels of corresponding second to kth display areas DA_2 to DA_k. Thus, image signals not updated at the current frame may be displayed at the second to kth display areas DA_2 to DA_k of the display panel 210.

In some example embodiments, the image signals not updated may be displayed at the display panel 210 using the image signals of the previous frame previously stored at the data driving unit 240. Thus, a power necessary to transfer the image signals not updated may not be required. This may mean that power consumption of the display system 300 of the inventive concept is reduced.

Figure 3:
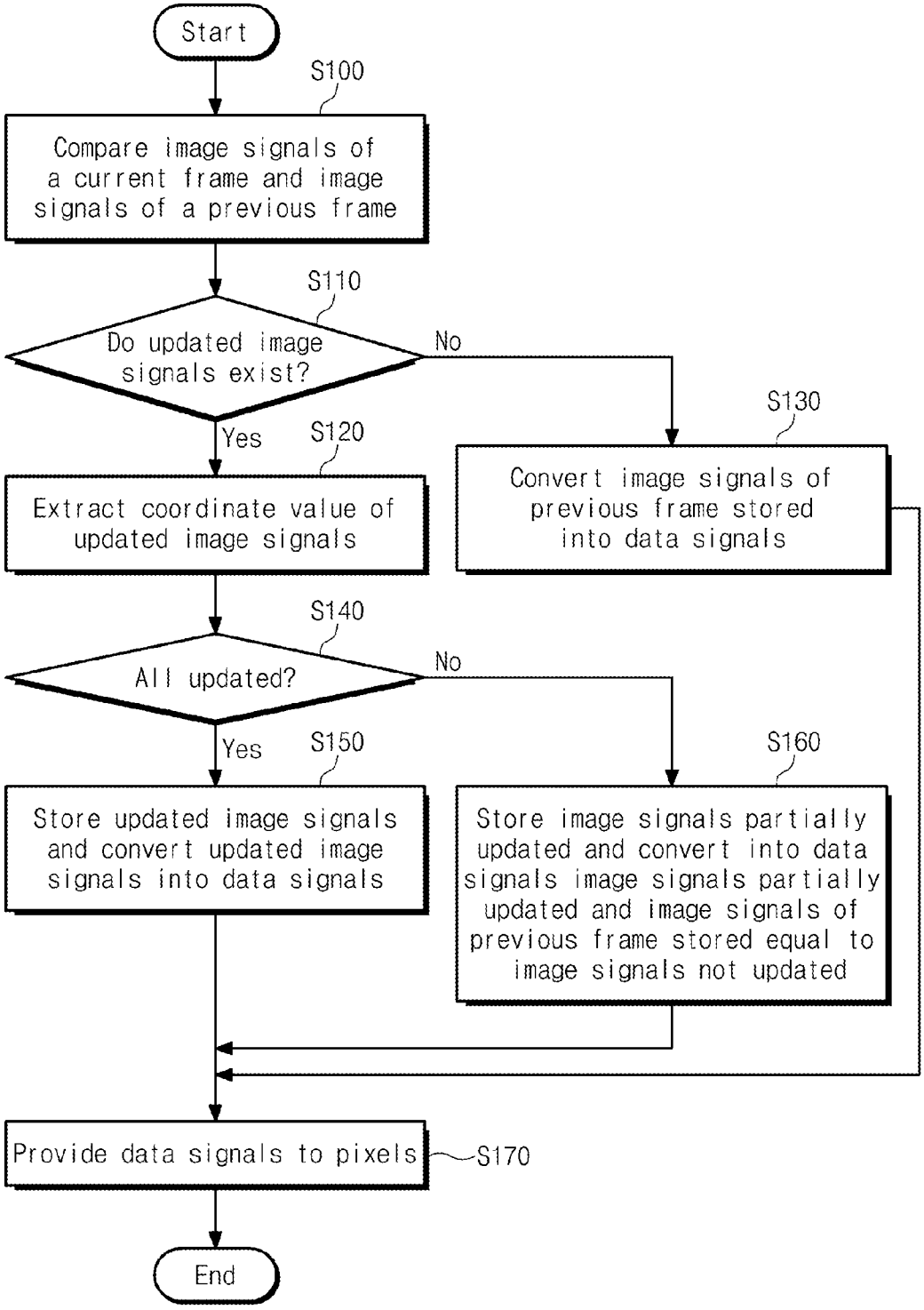
FIG. 3 is a flow chart illustrating a driving method of a display system according to some example embodiments of the inventive concept.

FIG. 3 is a flow chart illustrating a driving method of a display system according to some example embodiments of the inventive concept.

Referring to FIG. 3, in operation S100, image signals of a current frame may be compared with image signals of a previous frame. In operation S110, whether the image signals of the current frame include updated image signals may be determined based on the comparison result. If the image signals of the current frame include the updated image signals, in operation S120, a coordinate value of the updated image signals may be extracted. If the image signals of the current frame don't include the updated image signals, in operation S130, the image signals of a previous frame stored may be converted into data signals.

In operation S140, whether all image signals of the current frame are updated may be determined based on the coordinate value of the updated image signals. If all image signals of the current frame are determined to be updated, in operation S150, all image signals the current frame may be stored and converted into the data signals. If the image signals of the current frame are partially updated, in operation S160, the partially updated image signals of the image signals of the current frame may be stored, and the partially updated image signals of the image signals of the current frame and the image signals of a previous frame stored equal to image signals not updated may be converted into data signals. In operation S170, the data signals may be provided to pixels.

Thus, the updated image signals of image signals of a current frame may be converted into the data signals, and image signals not updated may be converted into the data signals using the image signals of the previous frame stored. Thus, with the driving method, it is possible to reduce power consumption of a display system 300 according to some example embodiments of the inventive concept.

FIGS. 4 to 7 are diagrams illustrating applications of multimedia devices including a display device 200 according to some example embodiments of the inventive concept.

Figure 4:
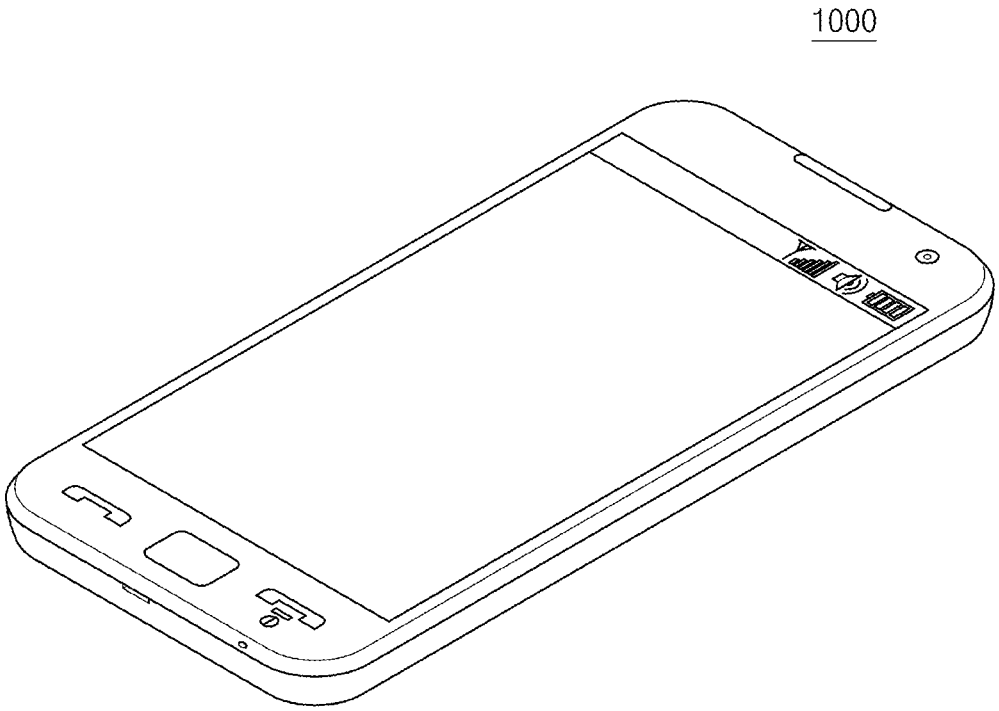
FIGS. 4 to 7 are diagrams illustrating applications of multimedia devices including a display device according to some example embodiments of the inventive concept.
Figure 5:
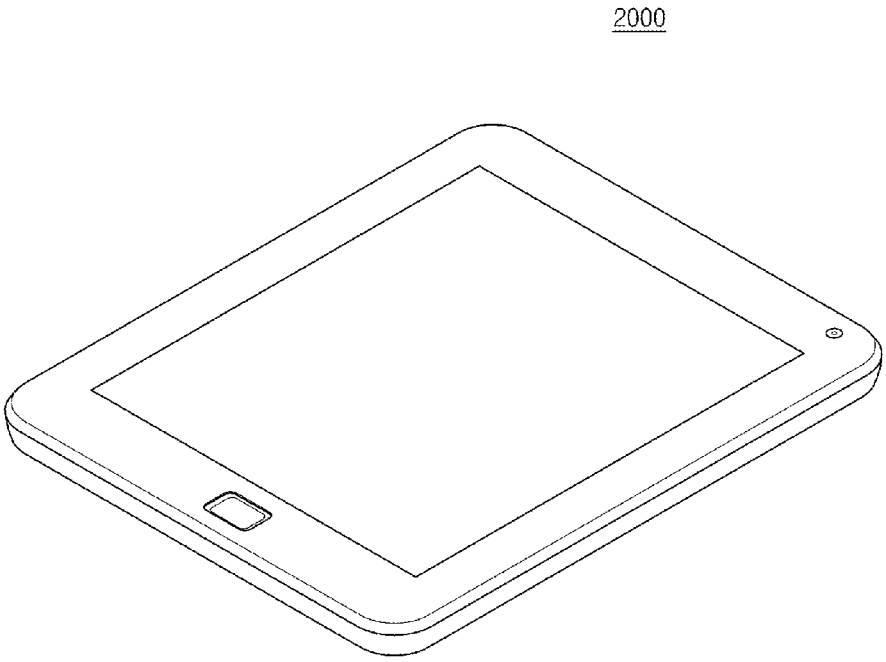
Figure 6:
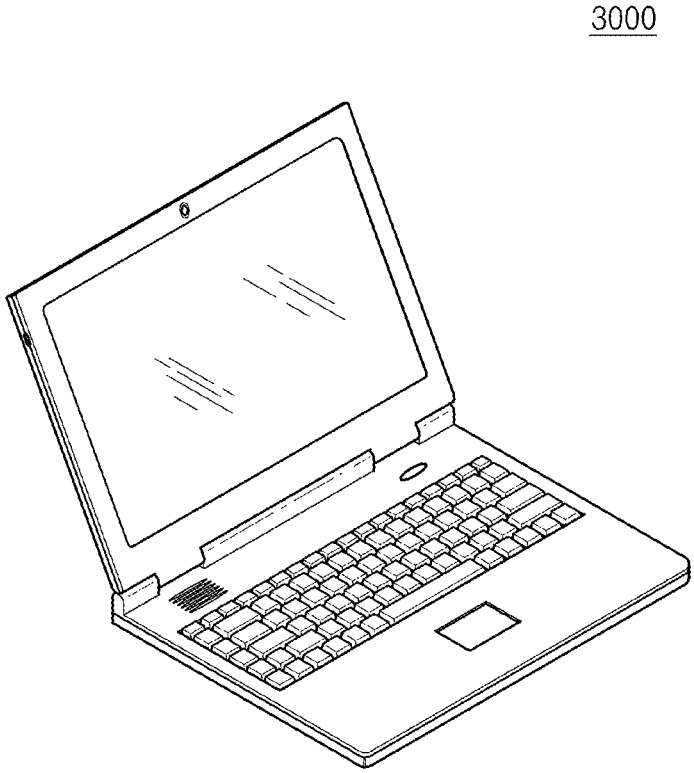
Figure 7:
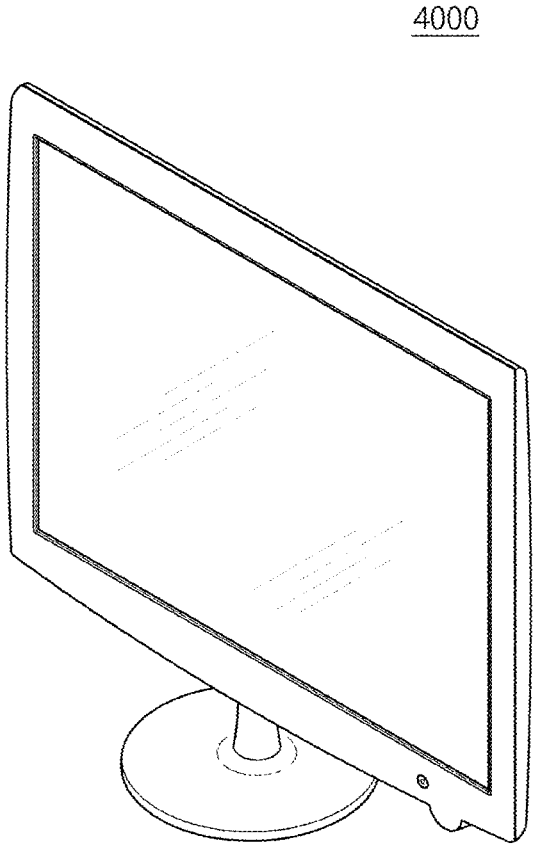

A display device 200 according to some example embodiments of the inventive concept may be applied to a variety of multimedia devices. For example, the display device 200 according to some example embodiments of the inventive concept may be applied to a mobile phone or a smart phone 1000 as illustrated in FIG. 4. The display device 200 according to some example embodiments of the inventive concept may be applied to a tablet PC or a smart tablet 2000 as illustrated in FIG. 5. The display device 200 according to some example embodiments of the inventive concept may be applied to a notebook computer 3000 as illustrated in FIG. 6. The display device 200 according to some example embodiments of the inventive concept may be applied to a television or a smart television 4000 as illustrated in FIG. 7.

While example embodiments have been particularly shown and described, it will be understood by those of ordinary skill in the art that various changes in form and details may be made therein without departing from the spirit and scope of the present invention as defined by the following claims.

What is claimed is:

1. A display system, comprising:

a system board configured to compare image signals of a current frame and image signals of a previous frame and configured to output the image signals of the current frame and a comparison result according to the comparison result;

a display panel configured to receive data signals in response to gate signals and configured to include a plurality of pixels for displaying images corresponding to the data signals;

a timing controller configured to output image signals and control signals;

a gate driving unit configured to provide the gate signals to the plurality of pixels in response to the control signals; and a data driving unit configured to store the image signals provided from the timing controller and configured to convert the image signals into the data signals in response to the control signals, the data signals being provided to the plurality of pixels;

wherein the timing controller provides the data driving unit with updated image signals of the image signals of the current frame provided from the system board based on the comparison result, and wherein if the image signals of the previous frame are equal to the image signals of the current frame, the system board does not provide the image signals of the current frame to the timing controller, and the data driving unit converts the image signals of the previous frame stored into the data signals to be provided to the pixels of the display panel.

2. The display system of claim 1, wherein the data driving unit is configured to convert, into the data signals, the updated image signals of the image signals of the current frame and stored image signals of the previous frame equal to image signals of the current frame not updated.

3. The display system of claim 1, wherein the display panel further comprises a plurality of display areas configured to include corresponding pixels of the plurality of pixels, and wherein the data driving unit is configured to include a plurality of source integrated circuits (ICs) corresponding to the plurality of display areas and providing the data signals to pixels of the corresponding display areas.

4. The display system of claim 3, wherein if the image signals of the current frame include the updated image signals, the system board is configured to provide the timing controller with location information of the updated image signals and the image signals of the current frame as the comparison result.

5. The display system of claim 4, wherein the timing controller is configured to extract a coordinate value of the updated image signals using the location information of the updated image signals.

6. The display system of claim 5, wherein the timing controller is configured to provide the updated image signals to the source ICs corresponding to the plurality of display areas at which the updated image signals are to be displayed, based on the coordinate value, and is configured to not to provide the source ICs with the image signals not updated.

7. The display system of claim 5, wherein each of the source ICs includes a frame memory configured to store image signals provided from the timing controller.

8. The display system of claim 7, wherein the frame memories of the source ICs provided with the updated image signals are configured to store the updated image signals provided from the timing controller and configured to convert the updated image signals into the data signals.

9. The display system of claim 7, wherein the image signals stored at the frame memories of the source ICs not provided with the image signals not updated from the timing controller are converted into the data signals.

10. A display system, comprising:

a display panel configured to include a plurality of pixels for displaying images corresponding to data signals;

a system board configured to output first image signals and first control signals;

a timing controller configured to output second image signals, second control signals, and third control signals based on the first image signals and the first control signals;

a data driving unit configured to store the second image signals and configured to convert the second image signals into data signals in response to the second control signals; and a gate driving unit configured to provide gate signals to the plurality of pixels in response to the third control signals;

wherein the system board is further configured to compare image signals of a current frame and image signals of a previous frame and further configured to output the image signals of the current frame according to the comparison result, wherein the timing controller is configured to provide the data driving unit with updated image signals of the image signals of the current frame provided from the system board based on the comparison result, wherein the plurality of pixels of the display panel is configured to receive the data signals, and wherein if the image signals of the previous frame are equal to the image signals of the current frame, the system board does not provide the image signals of the current frame to the timing controller, and the data driving unit converts the image signals of the previous frame stored into the data signals to be provided to the pixels of the display panel.

11. The display system of claim 10, wherein the first image signals include first red, green, and blue image signals.

12. The display system of claim 10, wherein the second image signals include second red, green, and blue image signals.

13. The display system of claim 10, wherein the first image signals include first red, green, and blue image signals, and wherein the second image signals include second red, green, and blue image signals converted from the first red, green, and blue image signals.

14. The display system of claim 10, wherein the second control signals include data control signals.

15. The display system of claim 10, wherein the third control signals include gate control signals.

16. The display system of claim 10, wherein the data driving unit comprises a plurality of frame memories configured to store the second image signals.

17. The display system of claim 10, wherein the display panel comprises a plurality of rows and columns of the plurality of pixels.

18. The display system of claim 17, wherein the display panel further comprises a plurality of display areas, and wherein each of the plurality of display areas corresponds to two or more columns of the plurality of pixels.

19. The display system of claim 17, wherein the display panel further comprises a plurality of image change areas, and wherein each of the plurality of image change areas corresponds to two or more rows and two or more columns of the plurality of pixels.

* * * * *